US006227738B1

(12) United States Patent
Ogura et al.

(10) Patent No.: US 6,227,738 B1
(45) Date of Patent: May 8, 2001

(54) METHOD OF MANUFACTURING INK FOLLOWER FOR WATER-BASE BALLPOINT PENS

(75) Inventors: Norio Ogura; Youji Takeuchi; Kiyoshi Iwamoto; Tadashi Kamagata; Katsuhiko Shiraishi, all of Yokohama (JP)

(73) Assignee: Mitsubishi Pencil Kabushikikaisha, Tokyo (JP)

( * ) Notice: Subject to any disclaimer, the term of this patent is extended or adjusted under 35 U.S.C. 154(b) by 0 days.

(21) Appl. No.: 09/424,580

(22) PCT Filed: Jul. 28, 1998

(86) PCT No.: PCT/JP98/03359

§ 371 Date: Nov. 26, 1999

§ 102(e) Date: Nov. 26, 1999

(87) PCT Pub. No.: WO99/04985

PCT Pub. Date: Feb. 4, 1999

(30) Foreign Application Priority Data

Jul. 28, 1997 (JP) ..... 9-215512
Jul. 3, 1998 (JP) ..... 10-188709

(51) Int. Cl.[7] ..... B43K 7/08
(52) U.S. Cl. ..... 401/142
(58) Field of Search ..... 401/142; 523/161; 29/527.1, 530; 366/241

(56) References Cited

U.S. PATENT DOCUMENTS

| | | | | |
|---|---|---|---|---|
| 2,969,041 | * | 1/1961 | Arengo | 401/142 |
| 3,424,537 | * | 1/1969 | Henriksen | 401/142 |
| 3,526,522 | * | 9/1970 | Seregely | 106/270 |
| 3,656,857 | * | 4/1972 | Seregely | 401/142 |
| 4,437,857 | * | 3/1984 | Goldstein et al. | 604/53 |
| 4,671,691 | * | 6/1987 | Case et al. | 401/142 |
| 5,348,989 | * | 9/1994 | Shiraishi | 523/161 |
| 5,874,488 | * | 2/1999 | Wang et al. | 523/161 |
| 6,012,864 | * | 1/2000 | Asami | 401/142 |
| 6,028,126 | * | 2/2000 | Wang et al. | 523/160 |

FOREIGN PATENT DOCUMENTS

| | | |
|---|---|---|
| 5-270192 | 10/1993 | (JP) . |
| 6-336584 | 12/1994 | (JP) . |
| 7-61187 | 3/1995 | (JP) . |

* cited by examiner

*Primary Examiner*—Gregory L. Huson
*Assistant Examiner*—Peter deVore
(74) *Attorney, Agent, or Firm*—Kubovcik & Kubovcik

(57) ABSTRACT

Lot-to-lot or time-dependent instability in quality of the known ink follower for water-base ballpoint pens is overcome. Particulate silica, or organic-treated clay is kneaded as thickener with base oil to prepare gel matter. The gel matter is pressurized to eliminate fine bubbles to yield ink follower for water-base ballpoint pens. The pressurization is preferably performed at 2 atm or higher. The elimination of the bubbles is more effective when the ink follower is, under pressurization, stirred and/or heated.

38 Claims, 1 Drawing Sheet

METHOD OF MANUFACTURING INK FOLLOWER FOR WATER-BASE BALLPOINT PENS

TECHNICAL FIELD

This invention relates to a method of manufacturing ink follower, which follows water-base ink filled in an ink reservoir of a ballpoint pen.

BACKGROUND ART

The Ink for a water-base ballpoint pen has a viscosity of as low as 50 mPa·s to 3 Pa·s, while the ink for a oil-base ballpoint pen, though is has a similar structure to a water-base one, has a viscosity of 3 to 20 Pa·s. Consequently, the ink filled in a water-base ballpoint pen may leak out when the pen is left upward or sideways. Moreover, even a small impact made on the pen may cause its ink to scatter and to stain the hand or the clothes. Therefore, the water-base ballpoint pen is equipped with ink follower for preventing such accidents.

There have been conventional arts for a water-base ballpoint pen with its ink in its ink reservoir that it is equipped ink follower composed of a gelled material, or a mixture of the gelled material and solid material. The aims of the arts are to make the ink follower follow the ink smoothly, to make the pen endure the impact when dropped, to prevent the ink from back flow, to give the pen a good appearance, and so on. A common feature of such arts is that the ink follower, which has pseudo-plasticity, is made from hardly-volatile or non-volatile solvent which is supplemented with some kind of thickener in order that the ink follower may not flow backward when the pen is left sideways or upward.

Another feature of such arts is that the known ink follower for water-base ballpoint pens often has very low viscosity and consistency, as compared with that for conventional oil-base ballpoint pens, which often has equal viscosity and consistency to common grease used for lubricant.

About as much as 50 to 300 mg of ink is required for writing a line of 100 m in length by a water-base ballpoint pen holding the ink in the ink reservoir, while only 10 to 30 mg of ink is required by an oil-base ballpoint pen.

Thus, the ink follower for the water-base ballpoint pens is required a strict ink-following performance, and is, therefore, mainly of low viscosity and consistency.

The ink follower for the water-base ballpoint pens consists of materials similar to the lubricant grease, and exhibits time-dependent behaviors based on similar physical laws.

Lubricant grease with low viscosity and consistency generally has such low stability that oily matter likely separates when left to stand. If the oily matter separates from ink follower, it affects writing adversely by reacting with surfactant in the ink, or by forming oil drops which block the ink passage.

The high mobility of thickener in the lubricant grease is likely to cause the grease to lose homogeneity easily by forming a mixture of coarse and dense portions. Ink follower lacking homogeneity is separated into a portion following ink and portions adhering to the inner wall of the ink reservoir. The adhering portions not only give the pen an unpleasant appearance, but also mean a corresponding loss of the ink follower, resulting eventually in its failure to function of, for example, preventing the ink from volatilizing or from leaking.

The lower the viscosity of the thickener of the grease is, the less effectively the thickener is dispersed by a disperser such as a two-roll mill, a three-roll mill, a kneader or a planetary mixer, any one of which is suitable for substances with high viscosity. The thickener is, however, not so low in viscosity as to be capable of being mixed effectively by a disperser such as a bead mill, a sand mill or a homogenizer, any one of which is suitable for substances with low viscosity. Inefficient dispersion causes not only time-dependent instability but also lot-to-lot instability in viscosity and uniformity.

The lubricant grease and the known ink follower have a common defect, too.

Namely, when they are used as ink follower in a water-base ballpoint pen which holds the ink in a cylindrical or similarly shaped ink reservoir with an inside diameter of 2.5 mm or larger, bubbles often occur between the ink and the ink follower by the passage of time. Moreover, bubbles or cracks, which have not seen initially, often occur in the ink follower (or the lubricant grease used as a substitute therefor) Namely, the greasy matter crack obviously. We, the inventors of this invention, call these phenomena "bubbling". Once the bubbling occurs between the ink and the ink follower, it grows larger and interrupts the contact between the ink and the ink follower. Then, the ink follower is urged by the vapor pressure of the ink toward the tail end of the pen, and eventually falls off. The ink follower having cracks or the like loses its function of keeping the ink from contact with the air.

These phenomena are presumably due to the invisibly fine bubbles that may exist in the ink follower or lubricant grease when manufactured. The bubbles gather with the passage of time, and tend to escape from the pen.

The bubbling is a serious defect in this kind of water-base ballpoint pen.

Commercially available ballpoint pens are subjected to a strong centrifugal force for debubbling. Debubbling by a strong centrifugal force is, however, not always effective for removing invisibly fine bubbles, but can only reduce the percentage of bubbling to about ⅕ to 1/20.

Moreover, the centrifuging is not a suitable method for debubbling for pens with a pigment ink, particularly the ink containing a pigment with a true specific gravity of 4 or higher, since a strong centrifugal force promotes the sedimentation of the pigment.

Fine bubbles can also be removed from ink follower when it is subjected to a reduced pressure. But the base oil for the ink follower is so high in viscosity that the bubbles which have expanded at a reduced pressure are not easily broken. Therefore, the method has a defect that the possible amount of the ink follower is limited to one-third to one-fifth of the capacity of a depressurizing vessel.

Considering above problems, the object of this invention is to dissolve the defect that conventional ink follower for a water-base ballpoint pen has lot-to-lot and time-dependent instability of quality, and to provide a method for manufacturing ink follower which has time-dependent stable performance for mass-production.

DISCLOSURE OF THE INVENTION

As a result of our diligent study of above problems, we have found that, homogenizing particulate silica, clay thickener, metal soap, or organic thickener microscopically highly, the thickener constantly exhibits its best performance. And we have also found that the ink follower, therefore, showed more time-dependent stability and less lot-to-lot instability. Thus we have completed our present invention.

Lubricant grease and ink follower for a water-base ballpoint pen are prepared from similar materials by similar processes, but are clearly different from each other from a technical standpoint.

The lubricant grease is usually used for lubricating, and is, therefore, made to have high structural viscosity and yield value lest the oily constituent of the grease drip from a point where the grease is applied. On the other hand, the ink follower for a water-base ballpoint pen is held in a reservoir with no opening except its rear end, and is used in an environment in which there is no sliding matter except itself. Therefore, the structural viscosity and yield value of the ink follower may be low. It would rather be correct to say that it is necessary for the ink follower to be low in structural viscosity and yield value in order to follow the ink smoothly.

Fine particulate powder such as inorganic thickener (particulate silica, alumina or titanium dioxide), inorganic or organic pigment and fine resin particulate, which gains structural viscosity in liquid, generally shows a lower thickening effect and a lower yield value when it is well-dispersed.

Clay thickener and organic thickener, which exhibit thickening effect by swelling with a solvent, tend to show a lower yield value when they are well-dispersed in liquid. So does metal soap.

Although the thickener of the ink follower, such as particulate thickener and clay thickener, appears to be thoroughly wet with the solvent, microscopically small bubbles exist in the core of the particle of the thickener because of its thickening effect that prevents the solvent from permeating thoroughly to its core. This is evident from the fact that the grease or the ink follower, though it appears bubble-free, produces a large number of bubbles under reduced pressure at much lower temperature than the boiling point of its oily constituent. So does metal soap thickener that seems to have, being prepared at high temperature, an advantage in permeability of the oily constituent.

In the present invention, we have improved the wetting of every particle of the thickener with solvent and caused the thickener to always exhibit its ability to its maximum degree. Thus we have given the ink follower stability in lot-to-lot viscoelasticity and performance. Moreover, the thickener being homogenized, we have successfully obtained ink follower for a water-base ballpoint pen with very good time-dependent stability. This invention relates to a method of manufacturing such followers under the conditions that satisfy above requirements.

The solvent used for the base oil for the ink follower is selected from polybutenes with a molecular weight of 500 to 3000, liquid paraffin, mineral oil such as spindle oil, silicone oil and so on. They do not dissolve in a water-base ink, and has only a small volatile loss. They generally have a better wetting property with resins, such as polypropylene, polyethylene and so on, used for an ink reservoir than that of water-base ink. Thus the consumption of the ink is easy to recognize.

Polybutenes and silicone oils, though some kinds of them are highly volatile, can withstand for at least two years of at room temperature if their volatile loss is not more than about 0.2% by weight under a JIS C-2320 method at 98° C. for five hours. The volatility of polybutenes largely depends upon their molecular weight. Polybutenes with average molecular weight more than about 500 may satisfy the above volatile loss.

Since the volatile loss of silicone oils also depends upon their molecular structure, it cannot be determined only by their molecular weight. Therefore, the volatile loss of silicone oils is recommended to be measured practically by the method as described above.

The thickener used for the present invention is preferably hydrophobic or insoluble. Hydrophilic thickener sometimes migrates into the ink through the surface between them. As a result, the ink follower loses of its viscosity, and the ink suffers an ill effect of being unable to write. However, hydrophilic thickener can be used if appropriate measures such as, for example, water-repelling treatment made to the thickener or the ink follower and the ink composition hard to be affected by the thickener are taken.

Preferred examples of the thickener are:

- particulate silica with methylated surfaces such as Aerozyls R-972, R-974D, R-976D and RY-200 (Nippon Aerozyl Co., Ltd.),
- organic thickener such as Leopar KE (Chiba Powder Manufacturing Co., Ltd.),
- organically-treated clay, which has hydrophobized surfaces by onium treatment, such as dimethyldioctadecyl ammonium bentonite, and
- insoluble metal soap such as lithium stearate, aluminum stearate and sodium stearate.

Each of above substances may be used alone, or may be used in combination with others. The total amount of thickener is preferably from 1 to 10% by weight of the ink follower.

Hydrophilic thickener, such as Aerozyl #200, 380, 300, 100 and OX50 (Nippon Aerozyl Co., Ltd.), particulate alumina and ultra-particulate titanium dioxide, can be prevented from interfering with the ink when the ink follower contains the substances such as surfactant, silane coupling agent, fluorocarbon, and methylhydrogen silicone, each of which has a hydrophilic-lipophilic balance (HLB) value of less than 4, preferably of less than 2. When silicone oil is used the for base oil of the ink follower, it is often possible for the ink follower, without adding other substance, to avoid interfering with the ink.

It is effective to use additive such as surfactant to the ink follower in order to improve its property of following the ink. Even irrespective of the kind of surfactant, it is not preferable to use the surfactant that dissolves in the ink during storage, but preferable to use nonionic surfactant with an HLB value less than 4. Moreover, the so-called fluorine-surfactant and silicone-surfactant are the most preferable additives for the present invention, in which the microscopic fine bubbles are eliminated by wetting the thickener thoroughly by pressure bubbling, since they can drastically lower the surface tension of the base oil.

It is also preferable for the object of this invention to add above-mentioned silane coupling agent, methylhydrogen silicone, etc. since they are effective for stabilization of the dispersion of the thickener, homogenization and hydrophobization. It is very preferable to use additives unless it makes an ill effect for the stability of the ink follower and for the quality of the ink.

The amount of these additives to be used is generally from 0.01%, which is minimal effective concentration, to about 5% by weight. The amount over 5% by weight does not produce any better result, though it may not present any problem in quality.

The above-mentioned base oil, thickener and, if necessary, additive are kneaded to form ink follower. In the present invention, the resultant gel mixture is pressurized to form the ink follower.

Namely, the pressurization is intended to wet the inside of the ink follower, or more particularly of the thickener, to eliminate invisible bubbles from the ink follower.

Bubbles can also be eliminated by the depressurization. This method, however, has a defect that the amount of the ink follower to be manufactured is limited to one-third to one-fifth of the capacity of a depressurizing vessel. That is because the bubbles swell by the depressurization, resulting that the ink follower also swells three to five times in volume. Moreover, the bubbles that have swelled do not easily break since the base oil in the ink follower has high viscosity.

Therefore, bubbles are eliminated by the pressurization. This method does not cause the ink follower to swell, but enables the effective use of the space in the depressurizing vessel.

Although pressurization over atmospheric pressure is effective for debubbling to some extent, our experiments show that the pressurization more than 2 atm is preferable. A sharp increase in the result of debubbling can be obtained by the pressurizing up to 2 atm, but only a small increase can be obtained thereafter. In other words, the result of debubbling substantially reaches its plateau at a pressure of 2 atm.

Moreover, the bubbles can also be eliminated by stirring the ink follower. A still better result can, however, be obtained by the pressurization under stirring.

Furthermore, the bubbles can also be eliminated by heating the ink follower. That is because the surface tension of the solvent appears to be lowered by the heating and to wet even invisibly small bubbles in the thickener. If stirring is continued for a long time at a temperature over 100° C., the thickener is satisfactorily wetted even at atmospheric pressure. Nevertheless, similar results can be obtained in a shorter time by the pressurization under stirring. Still better results can be obtained by the pressurization under heating.

Still much better results can be obtained by the pressurization under heating and stirring.

Description will now be made in further detail of the method in the present invention.

The above-mentioned base oil, thickener and, if necessary, additive are kneaded together in a two-roll mill or a three-roll mill to form gel matter.

The gel matter is transferred into a pressurizing vessel, and pressurized above atmospheric pressure for the elimination of bubbles. The pressure to be applied is preferably more than 2 atm as stated above. The vessel is preferably of the type that is also adapted for stirring or heating, or for both.

After that, an ink reservoir is charged with ink, fitted up with a writing tip, and filled with the ink follower as prepared above. Then a strong centrifugal force is applied from the tail end toward the writing tip, and the ink reservoir can be charged beautifully without having any air trapped between the ink and the ink follower.

The use of a two-roll mill or a three-roll mill at a high temperature is also effective for preparing ink follower containing a few bubbles. A better debubbling effect can, however, be obtained when the ink follower, transferred into a vessel adapted for pressurizing and heating, is pressurized.

BEST MODE FOR CARRYING OUT THE INVENTION

Figure 1:
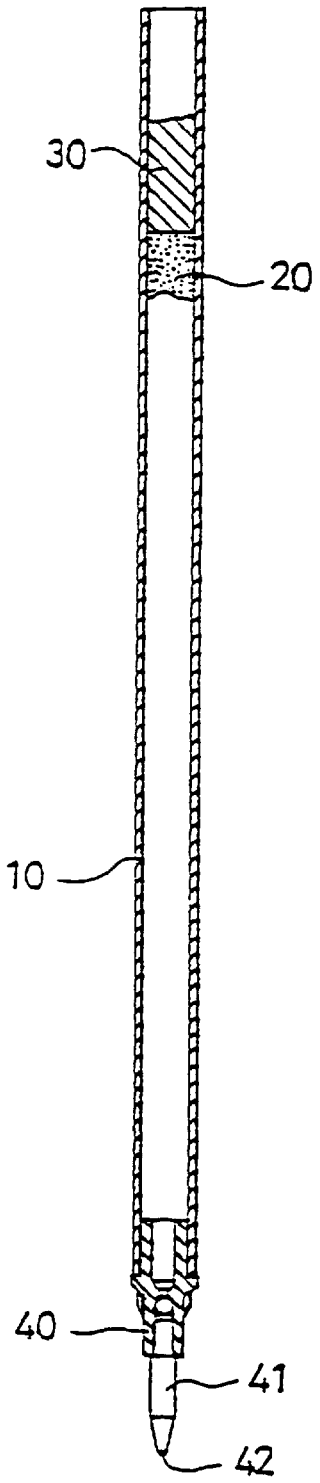
FIG. 1 is a longitudinal sectional view of a refill holder for a water-base ballpoint pen holding the ink follower as prepared in accordance with the present invention.

The present invention will now be described in further detail based on Test Examples thereof and Comparative Examples.

(Ink Followers)

Ink followers were prepared, and tested as will be described below.

Gel matter 1 containing particulate silica as thickener and fluorine surfactant as additive was prepared by kneading the materials as shown in Table 1 below in a three-roll mill (manufactured by Kodaira Mfg. Works, Ltd., with a roll diameter of 13 cm) three times.

TABLE 1

| Composition | Parts by weight |
|---|---|
| Polybutene 35R<br>(Idemitsu Kosan Co., Ltd., MW = 720) | 47.4 |
| Aerozyl R-976D<br>(Particulate silica, Nippon Aerozyl Co., Ltd.) | 5.0 |
| EFTOP EF-801<br>(Fluorine surfactant, Mitsubishi Materials Corp.) | 0.1 |
| Diana Process Oil<br>(Mineral oil, Idemitsu Kosan Co., Ltd.) | 47.5 |

Moreover, gel matter 2 containing organic-treated clay as thickener and silane coupling agent as additive was prepared by kneading the materials as shown in Table 2 below in the above three-roll mill twice.

TABLE 2

| Composition | Parts by weight |
|---|---|
| Nissan Polybutene 015N<br>(NOF Corp., MW = 580) | 95.0 |
| BENTON 34<br>(Organic-treated clay, Wilber Elis Co.) | 4.0 |
| KBM 504<br>(Silane coupling agent, Shin-Etsu Chemical Co., Ltd.) | 1.0 |
| Methanol | 2.0 |

Methanol was lost by volatilization during the kneading.

Furthermore, gel matter 3 containing particulate silica as thickener and silane coupling agent as additive was prepared by kneading the materials as shown in Table 3 below for an hour in a planetary mixer (Model 5DMV, Dalton Co., Ltd.).

TABLE 3

| Composition | Parts by weight |
|---|---|
| TSF451-3000<br>(Dimethylsilicone oil, Toshiba Silicone Co., Ltd.) | 70.0 |
| Aerozyl 200<br>(Particulate silica, Nippon Aerozyl Co., Ltd.) | 4.0 |
| A174<br>(Silane coupling agent, Nippon Unicar Co.) | 1.0 |

Twenty-five parts by weight of TSF451-3000 as shown in Table 3 was added to the gel matter 3 during the stirring as will be described below.

The above-mentioned gel matter 1, 2 or 3 was treated under the conditions as shown in Table 4 below to prepare ink follower according to each Test Example or Comparative Example. A table reactor (Model OM, OM Labotec Co., Ltd.) was used for pressurizing and stirring, and an electric mantle heater for heating.

TABLE 4

| Test/Comparative Example | Gel matter | Pressure | Temperature | Treating time | Treatment |
|---|---|---|---|---|---|
| Test Example 1 | Gel matter 1 | 1.8 atm. | Ambient | 1 hour | Still |
| Test Example 2 | Gel matter 1 | 2 atm. | Ambient | 1 hour | Still |
| Test Example 3 | Gel matter 1 | 5 atm. | Ambient | 1 hour | Still |
| Test Example 4 | Gel matter 1 | 1.8 atm. | Ambient | 1 hour | Stirring |
| Test Example 5 | Gel matter 1 | 2 atm. | Ambient | 1 hour | Stirring |
| Test Example 6 | Gel matter 1 | 5 atm. | Ambient | 1 hour | Stirring |
| Test Example 7 | Gel matter 1 | 2 atm. | 100° C. | 1 hour | Stirring |
| Test Example 8 | Gel matter 1 | 2 atm. | 130° C. | 1 hour | Stirring |
| Test Example 9 | Gel matter 2 | 1.8 atm. | Ambient | 1 hour | Still |
| Test Example 10 | Gel matter 2 | 2 atm. | Ambient | 1 hour | Still |
| Test Example 11 | Gel matter 2 | 5 atm. | Ambient | 1 hour | Still |
| Test Example 12 | Gel matter 2 | 1.8 atm. | Ambient | 1 hour | Still |
| Test Example 13 | Gel matter 2 | 2 atm. | Ambient | 1 hour | Stirring |
| Test Example 14 | Gel matter 2 | 5 atm. | Ambient | 1 hour | Stirring |
| Test Example 15 | Gel matter 2 | 2 atm. | 100° C. | 1 hour | Stirring |
| Test Example 16 | Gel matter 2 | 2 atm. | 130° C. | 1 hour | Stirring |
| Test Example 17 | Gel matter 3 | 1.8 atm. | Ambient | 1 hour | Stirring |
| Test Example 18 | Gel matter 3 | 2 atm. | Ambient | 1 hour | Stirring |
| Test Example 19 | Gel matter 3 | 5 atm. | Ambient | 1 hour | Stirring |
| Test Example 20 | Gel matter 3 | 2 atm. | 100° C. | 1 hour | Stirring |
| Test Example 21 | Gel matter 3 | 2 atm. | 130° C. | 1 hour | Stirring |
| Comparative Example 1 | Gel matter 1 | — | — | — | — |
| Comparative Example 2 | Gel matter 1 | Atmospheric | Ambient | 1 hour | Stirring |
| Comparative Example 3 | Gel matter 1 | Atmospheric | Ambient | 24 hours | Stirring |
| Comparative Example 4 | Gel matter 1 | Atmospheric | Ambient | 48 hours | Stirring |
| Comparative Example 5 | Gel matter 1 | Atmospheric | 130° C. | 24 hours | Still |
| Comparative Example 6 | Gel matter 1 | Atmospheric | 130° C. | 1 hour | Stirring |
| Comparative Example 7 | Gel matter 2 | — | — | — | — |
| Comparative Example 8 | Gel matter 2 | Atmospheric | Ambient | 1 hour | Stirring |
| Comparative Example 9 | Gel matter 2 | Atmospheric | Ambient | 24 hours | Stirring |
| Comparative Example 10 | Gel matter 2 | Atmospheric | Ambient | 48 hours | Stirring |
| Comparative Example 11 | Gel matter 2 | Atmospheric | 130° C. | 24 hours | Still |
| Comparative Example 12 | Gel matter 2 | Atmospheric | 130° C. | 1 hour | Stirring |
| Comparative Example 13 | Gel matter 3 | Atmospheric | Ambient | 1 hour | Stirring |
| Comparative Example 14 | Gel matter 3 | Atmospheric | Ambient | 24 hours | Stirring |
| Comparative Example 15 | Gel matter 3 | Atmospheric | Ambient | 48 hours | Stirring |
| Comparative Example 16 | Gel matter 3 | Atmospheric | 130° C. | 1 hour | Stirring |

As is shown in Table 4, the products of Comparative Examples 1 and 7 were made without giving any treatment to the gel matter 1 and 2, respectively.

Five lots of products were made from the same materials in each of Test Examples 1 to 21 and of Comparative Examples 1 to 16.

(Test Methods)

(Test 1: Viscosity Difference Test)

Viscosity was measured of each of the five lots of ink followers according to each Test Example or Comparative Example by an E-type viscometer in one rotation at a cone angle of 3 degrees. Then the ratio of the maximum value to the minimum one was shown in percentage. Therefore, the closer the ratio is towards the value of 100, the smaller the lot-to-lot difference of viscosity is.

(Test 2: Time-Dependent Stability-1 <Oil Separation Test>)

The product of each of the five lots according to each Test Example or Comparative Example was made to fill a level of one-liter stainless steel beaker without any visible bubble. Then a hole corresponding to a half of a ping-pong ball was made on the level. The beaker was left to stand for one week in a water bath at a temperature of 50° C.

After that, the volume of oil oozing in the hole was determined. The volume less than 1.5 ml was estimated as zero point, the volume of 1.5 ml or more and less than 3.5 ml as 3 points, and the volume of 3.5 ml or more as 5 points. Then the total of the points gained by the five lots was recorded as the score of each Test Example or Comparative Example. Therefore, the fewer the score is, the less the oil separates from the ink follower.

(Test 3: Time-Dependent Stability-2 <Pen Storage Test>)

Ten ballpoint pens as shown in FIG. 1 were assembled using the ink follower of each lot according to each Test Example or Comparative Example. A semi-transparent polypropylene tube with an inside diameter of 4.0 mm was used as an ink reservoir 10 for each pen. The ink reservoir 10 was charged with water-base ink 20, and awriting tip used in a commercially available ballpoint pen (UM-100, Mitsubishi Pencil Co., Ltd.) as shown in FIG. 1 was fitted as a writing tip 41. The writing tip 41 was made of free-cutting stainless steel, and held a ball 42 made of tungsten carbide with a diameter of 0.5 mm. Then, ink follower 30 was introduced into the ink reservoir 10 through its rear end.

The above-mentioned ink 20 had been prepared by kneading the materials as shown in Table 5 below in a beadmill, removing coarse particles of carbon black, and adding the materials as shown in Table 6. The ink had viscosity of 500 mPa·s at 40s<SUP>−1</SUP>.

TABLE 5

| Composition | Parts by Weight |
|---|---|
| Printex 25 (Carbon black, Degussa) | 7.0 |
| PVP K-30 (Polyvinyl pyrrolidone, GAF) | 3.5 |
| Glycerol | 10.0 |
| Potassium ricinolate | 0.5 |
| Triethanolamine | 1.0 |
| 1,2-Benzisothiazoline-3-one | 0.2 |
| Benzotriazole | 0.2 |
| Water | 27.2 |

TABLE 6

| Composition | Parts by Weight |
|---|---|
| Propylene glycol | 20.0 |
| Carbopol (Crosslinking polyacrylic acid, B. F. Goodrich Co.) | 0.4 |
| Water | 30.0 |

A centrifugal force was applied to each pen from its tail end to its writing tip by a Model H-103N centrifugal separator (supplied by Kokusan Centrifuge Co., Ltd.) at 2800 rpm for ten minutes to drive the bubbles away from the pen.

Then, the pens were left to stand for one month in a water bath at 50° C. with their writing tips upward, and were thereafter visually checked for any oily matter mixed in the ink. The number of pens that were found to contain the oily matter in the ink was counted and estimated as a score. As ten pens were assembled for each of the five lots of ink follower, a total of fifty pens were assembled for each Test Example and Comparative Example. Therefore, the best score is zero, while the worst is fifty.

(Test 4: Time-Dependent Stability-3 <Bubbling Test>)

Ballpoint pens assembled as those of the Test 3 were left to stand for one month in a water bath at 50° C. with their writing tips downward. Thereafter, the pens were visually checked for any crack between the ink and the ink follower, or in the ink, or in the ink follower. The number of pens that were found to have any such crack were counted and estimated as a score. As ten pens were assembled for each of the five lots of ink follower, a total of fifty pens were assembled for each Test Example and Comparative Example. Therefore, the best score is zero, while the worst is fifty.

(Evaluation)

The results of Tests 1 to 4 are shown in Table 7 for each of Test Examples and Comparative Examples.

TABLE 7

| Ink follower | Test 1 | Test 2 | Test 3 | Test 4 |
|---|---|---|---|---|
| Test Example 1 | 191 | 15 | 12 | 20 |
| Test Example 2 | 183 | 15 | 12 | 18 |
| Test Example 3 | 175 | 12 | 10 | 10 |
| Test Example 4 | 168 | 12 | 9 | 6 |
| Test Example 5 | 120 | 6 | 2 | 0 |
| Test Example 6 | 112 | 3 | 0 | 0 |
| Test Example 7 | 113 | 0 | 0 | 3 |
| Test Example 8 | 108 | 0 | 0 | 0 |
| Test Example 9 | 165 | 15 | 15 | 20 |
| Test Example 10 | 162 | 15 | 12 | 17 |
| Test Example 11 | 160 | 15 | 12 | 15 |
| Test Example 12 | 155 | 12 | 9 | 6 |
| Test Example 13 | 130 | 3 | 5 | 2 |
| Test Example 14 | 120 | 2 | 2 | 0 |
| Test Example 15 | 118 | 2 | 0 | 0 |
| Test Example 16 | 109 | 0 | 1 | 0 |
| Test Example 17 | 210 | 12 | 0 | 20 |
| Test Example 18 | 185 | 12 | 0 | 15 |
| Test Example 19 | 160 | 9 | 0 | 12 |
| Test Example 20 | 121 | 0 | 0 | 0 |
| Test Example 21 | 110 | 0 | 0 | 0 |
| Comparative Example 1 | 220 | 25 | 25 | 45 |
| Comparative Example 2 | 201 | 19 | 21 | 23 |
| Comparative Example 3 | 190 | 15 | 12 | 20 |
| Comparative Example 4 | 185 | 15 | 12 | 15 |
| Comparative Example 5 | 177 | 12 | 9 | 12 |
| Comparative Example 6 | 172 | 10 | 9 | 13 |
| Comparative Example 7 | 180 | 25 | 20 | 32 |
| Comparative Example 8 | 175 | 20 | 20 | 18 |
| Comparative Example 9 | 170 | 15 | 12 | 12 |
| Comparative Example 10 | 170 | 13 | 12 | 10 |
| Comparative Example 11 | 168 | 12 | 9 | 12 |
| Comparative Example 12 | 164 | 9 | 8 | 12 |
| Comparative Example 13 | 625 | 50 | 50 | 50 |
| Comparative Example 14 | 310 | 15 | 12 | 15 |
| Comparative Example 15 | 225 | 15 | 9 | 8 |
| Comparative Example 16 | 220 | 15 | 8 | 7 |

First, evaluation will be made of the results of Test 1 as conducted for examining a lot-to-lot difference of viscosity.

Referring to the ink follower 1 prepared by using particulate silica as the thickener, Comparative Example 1, for which any treatment had not been employed, showed a maximum lot-to-lot difference of 2.2 times in viscosity.

On the other hand, Test Examples 1 to 3, in which only the pressurization had been performed, showed a improved difference of 1.91 to 1.75 times. Comparative Examples 2 to 4, in which only stirring had been performed, also showed a improved maximum difference of 2.01 to 1.85 times, but better results were obtained by the pressurization.

Substantially the same result was obtained by 48 hours' stirring at room temperature and atmospheric pressure (Comparative Example 4; 1.85 times) as that by pressurizing at 2 atm for one hour at room temperature without stirring (Test Example 2; 1.83 times). It is, thus, obvious that the pressurization requires a shorter time than stirring for achieving similar results, and that the pressurization is more effective for reducing lot-to-lot difference in viscosity of ink followers.

Test Examples 4 to 6, in which both the pressurization and stirring had been performed, showed a more improved maximum difference in viscosity of 1.68 to 1.12 times.

As to the pressurization, the difference of pressure between Test Example 1 and 2 was 0.2 atm, while that between Test Example 2 and 3 was 3 atm. However, the similar extent to which the difference of viscosity has improved was observed between these differences of pressure. Therefore, the effect of the increased pressure from 1.8 to 2.0 atm was shown to be equal to that from 2 to 5 atm.

This tendency was more markedly shown by Test Examples 4 to 6 in which the pressurization had been performed under stirring. Namely, the difference of 1.68 times was observed in Test Example 4 in which the pressure was 1.8 atm, whereas the strikingly improved difference of 1.20 times was observed in Test Example 5 in which the pressure was 0.2 atm more than that in Test Example 4. On the other hand, only limited improved difference of 1.12 times was observed in Test Example 6 in which the pressure was 3 atm more than that in Test Example 5. It is obvious from these results that a drastic improvement in viscosity difference was observed by the pressurization up to 2 atm under stirring, but that such improvement substantially reached its plateau by the pressurization over 2 atm. Thus, the pressurization at 2 atm is considered to have a particular effect for the improvement in viscosity difference.

Comparative Example 5 in which only heating had been performed showed an improved maximum difference of viscosity of 1.77 times to that of Comparative Example 1. This effect is substantially equal to that of Test Example 2 (1.83 times) in which the pressurization at 2 atm for an hour. It is, therefore, obvious that the pressurization is more effective than heating for reducing lot-to-lot difference in viscosity.

Next, the effect of heating and that of pressurization are compared when stirring is performed. Comparative Example 6, in which heating had been performed under stirring, showed a maximum viscosity difference of 1.72 times, whereas Test Example 5, in which pressurization had been performed under stirring, showed a difference of 1.20 times. It is, thus, obvious that the pressurization is by far more effective than the heating if the other conditions are equal.

Test Examples 7 and 8, in which pressurization, stirring and heating had all been performed simultaneously, showed better results than that of Test Example 5, but the extent to which the improvement was observed was not so great. Therefore, the heating slightly improved the effect, which substantially reached its plateau by the pressurization and stirring (cf. Test Example 5).

It is, thus, obvious that, though each of pressure, stirring and heat may contribute to the improvement of lot-to-lot viscosity difference, most of the expected improvement can be achieved by the pressurization and stirring. Particularly, the pressurization gives a greater contribution according to above results.

The similar tendency was also found in the ink followers 2 of Test Examples 9 to 16 and Comparative Examples 7 to 12, in which organic-treated clay was used as thickener.

Namely, while Comparative Example 2, in which any treatment was not performed, showed a maximum viscosity difference of 1.80 times, Test Example 10, in which pressurization was performed at 2 atm for an hour, showed a better result (1.62 times) than Comparative Example 4, in which 48 hours' stirring was performed (1.85 times). Moreover, as was the case with the ink follower 1, Test Example 10 was more effective than Comparative Example 11 (1.64 times), in which 24 hours' heating was performed. Similarly, when stirring was performed, Test Example 13 (1.30 times), in which the pressurization was performed, was more effective than Comparative Example 12, in which heating was performed.

Furthermore, in the case that the pressurization is performed under stirring, the effect of increased pressure from 1.8 to 2 atm was from 1.55 (Test Example 12) to 1.30 times (Test Example 13) whereas that from 2 to 5 atm was from 1.30 (Test Example 13) to 1.20 times (Test Example 14). Therefore, it is obvious for the ink follower 2 that the improvement of increased pressure up to 2 atm substantially reaches its plateau.

The above tendency was more clearly shown by the ink followers 3, in which the base oil and the thickener were difficult to mix with each other, as shown in Test Examples 17 to 21 and Comparative Examples 13 to 16. Namely, while Comparative Example 13 showed maximum viscosity difference of 6.25 times by an hour's stirring, Test Example 18 showed drastically improved difference of 1.85 times by the additional pressurization at 2 atm. This improvement was greater than that by 48 hours' stirring (Comparative Example 15; 2.25 times), or than that by heating under stirring (Comparative Example 16; 2.20 times).

In the case that the pressurization is performed under stirring, the effect of the increased pressure from 1.8 to 2 atm was from 2.10 (Test Example 17) to 1.85 times (Test Example 18) whereas that from 2 to 5 atm was from 1.85 (Test Example 18) to 1.60 times (Test Example 19). Therefore, it is obvious for the ink follower 3 that the improvement of increased pressure up to 2 atm substantially reaches its plateau.

Moreover, as shown in Tests 2 and 3, in which the compatibility of the base oil and the thickener was examined, and in Test 4, in which the elimination of bubbles from the ink follower was examined, among the factors of pressurization, heating and stirring, the pressurization gave the greatest contribution to the improvement. Particularly, in the case that the pressurization was performed under stirring, as shown in Test Examples 5 and 6 (ink follower 1) against Test Example 4 and in Test Examples 13 and 14 (ink follower 2) against Test Example 12, marked improvement was similarly observed at more than 2 atm.

Furthermore, in the case that pressurization, heating and stirring were performed simultaneously, almost perfect results were obtained for the ink follower 1 (Test Examples 7 and 8), in which particulate silica was used as the thickener, for the ink follower 2 (Test Examples 15 and 16), in which organic-treated clay was used as the thickener and for the ink follower 3 (Test Examples 20 and 21), in which particulate silica, which has ill compatibility with the base oil, as the thickener.

Namely, the score of zero, or close to zero was obtained in Test 2 examining the separation of the oily matter, in Test 3 examining the migration of the oily matter into the ink and in Test 4 examining the elimination of the bubbles. Although Test Example 15 in Test 2 (2 points), Test Example 16 in Test 3 (1 point) and Test Example 7 in Test 4 (3 points) did not show a score of zero, these results can be interpreted as being zero in view of the fact that the tests had been conducted at a severe condition at as high as 50° C.

These results were, however, achieved by pressurizing at 2 atm under stirring, as shown in Test Example 5 of the ink follower 1, in Test Example 13 of the ink follower 2, and in Test Example 18 of the ink follower 3.

The summary of the above results is as follows.

First, the pressurization was found to be effective for improving lot-to-lot difference in viscosity of the ink follower, the compatibility of the base oil and the thickener, and debubbling from the ink follower.

Second, the additional stirring to the pressurization was found to be more effective.

Third, the additional heating to the pressurization and stirring was found to be much more effective.

Fourth, the increased pressure up to 2 atm brought about striking improvement, but no significant improvement was given by the higher pressure.

Fifth, the above improvement was observed when either particulate silica or organic-treated clay was used as the thickener.

Similar results were obtained in the above-mentioned tests for the ink follower containing:

- at least any one of polybutene, liquid paraffin, spindle oil, dimethylsilicone oil and methylphenylsilicone oil as the base oil,
- at least any one of Aerozyl R-972, R-974D, R-976D, RY-200, #200, 380, 300, 100 and OX50, Titanium Dioxide P25, Aluminum Oxide (Nippon Aerozyl Co., Ltd.), BENTON 27, 34 and EW (Wilber-Elis Co.), Synthetic Smectite SAN, SAF and SWN (Cope Chemical Co.) as the thickener, and
- at least any one of surfactant, such as fluorine- and silicone-surfactant, polyoxyethylene derivatives, glycerol-polyglycerol derivatives, sorbitan derivatives, and phosphoric acid esters, silane coupling agent, and titanium coupling agent as additive.

Although a laboratory reactor was employed for the pressurizing the ink follower in above-mentioned embodiments, similar results can also be obtained by using any other type of stirring vessel capable of pressurizing.

As mentioned above, the present invention provides a method, which can overcome the defect of lot-to-lot or time-dependent instability in the conventional ink follower for a water-base ballpoint pen, and by which the ink follower with time-dependent stability for mass-production can be manufactured.

Industrial Utility

As mentioned above, the method of the present invention is useful for preparing ink follower used to fill the rear end of water-base ink held in an ink reservoir of a ballpoint pen.

What is claimed is:

1. A method of manufacturing an ink follower for a water-base ballpoint pen by kneading a base oil and thickener, wherein the ink follower is pressurized for at least 60 minutes after the base oil and the thickener are kneaded.

2. A method according to claim 1, wherein the ink follower is heated after the base oil and the thickener is kneaded.

3. A method according to claim 2, wherein the ink follower is pressurized at 2 atm or higher.

4. A method according to claim 3, wherein the thickener is particulate silica.

5. A method according to claim 4, wherein the thickener is organic-treated clay.

6. A method according to claim 5, wherein the ink follower is charged to an ink reservoir.

7. A method according to claim 4, wherein the ink follower is charged to an ink reservoir.

8. A method according to claim 3, wherein the thickener is organic-treated clay.

9. A method according to claim 8, wherein the ink follower is charged to an ink reservoir.

10. A method according to claim 2, wherein the thickener is particulate silica.

11. A method according to claim 10, wherein the thickener is organic-treated clay.

12. A method according to claim 2, wherein the thickener is organic-treated clay.

13. A method according to claim 1, wherein the ink follower is pressurized at 2 atm or higher.

14. A method according to claim 13, wherein the thickener is particulate silica.

15. A method according to claim 14, wherein the thickener is organic-treated clay.

16. A method according to claim 13, wherein the thickener is organic-treated clay.

17. A method according to claim 1, wherein the thickener is particulate silica.

18. A method according to claim 17, wherein the thickener is organic-treated clay.

19. A method according to claim 1, wherein the thickener is organic-treated clay.

20. A method of manufacturing an ink follower for a water-base ballpoint pen by kneading a base oil and thickener, wherein the ink follower is stirred in a stirring vessel under pressurization after the base oil and thickener are kneaded.

21. A method according to claim 20, wherein the ink follower is heated after the base oil and the thickener is kneaded.

22. A method according to claim 21, wherein the ink follower is pressurized at 2 atm or higher.

23. A method according to claim 22, wherein the thickener is particulate silica.

24. A method according to claim 23, wherein the thickener is organic-treated clay.

25. A method according to claim 24, wherein the ink follower is charged to an ink reservoir.

26. A method according to claim 23, wherein the ink follower is charged to an ink reservoir.

27. A method according to claim 22, wherein the thickener is organic-treated clay.

28. A method according to claim 27, wherein the ink follower is charged to an ink reservoir.

29. A method according to claim 21, wherein the thickener is particulate silica.

30. A method according to claim 29, wherein the thickener is organic-treated clay.

31. A method according to claim 21, wherein the thickener is organic-treated clay.

32. method according to claim 20, wherein the ink follower is pressurized at 2 atm or higher.

33. A method according to claim 32, wherein the thickener is particulate silica.

34. A method according to claim 33, wherein the thickener is organic-treated clay.

35. A method according to claim 32, wherein the thickener is organic-treated clay.

36. A method according to claim 20, wherein the thickener is particulate silica.

37. A method according to claim 36, wherein the thickener is organic-treated clay.

38. A method according to claim 20, wherein the thickener is organic-treated clay.

* * * * *